United States Patent [19]

Tsuzurabara

[11] Patent Number: 4,558,250

[45] Date of Patent: Dec. 10, 1985

[54] CATHODE STRUCTURE OF ELECTRON TUBE

[75] Inventor: Mamoru Tsuzurabara, Mobara, Japan

[73] Assignee: Hitachi, Ltd., Tokyo, Japan

[21] Appl. No.: 188,507

[22] Filed: Sep. 18, 1980

[30] Foreign Application Priority Data

| | | | |
|---|---|---|---|
| Oct. 19, 1979 | [JP] | Japan | 54-143873[U] |
| Nov. 21, 1979 | [JP] | Japan | 54-150069 |
| Apr. 23, 1980 | [JP] | Japan | 55-52972 |

[51] Int. Cl.[4] ..... H01J 1/20

[52] U.S. Cl. ..... 313/337; 313/341

[58] Field of Search ..... 313/337, 341; 4/288

[56] References Cited

U.S. PATENT DOCUMENTS

| | | | |
|---|---|---|---|
| 1,797,990 | 3/1931 | Lucian | 313/337 |
| 1,868,604 | 7/1932 | Horn | 313/337 |
| 2,349,202 | 5/1944 | Slezak | 4/288 |
| 2,768,321 | 10/1956 | Peterson | 313/337 |
| 2,957,100 | 10/1960 | Espersen et al. | 313/337 |
| 3,192,436 | 6/1965 | Jewart | 313/337 |
| 3,314,085 | 4/1967 | Minella | 4/288 |

*Primary Examiner*—Harold Dixon

*Attorney, Agent, or Firm*—Antonelli, Terry & Wands

[57] ABSTRACT

A cathode structure of a thermal electron emitting cathode of an electron tube, particularly of a magnetron for preventing the damage and break due to mechanical vibration of the cathode. A spacer is interposed in a space between a center lead and a lower end shield to prevent the vibration through the center lead. The antivibration effect of the filament cathode is attained by arranging the spacer having an aperture through which the center lead and a side lead extend such that the spacer contacts to an inner wall of a shielding member which constitutes a portion of a vacuum envelope of the magnetron.

8 Claims, 15 Drawing Figures

CATHODE STRUCTURE OF ELECTRON TUBE

BACKGROUND OF THE INVENTION

The present invention relates to a cathode structure of an electron tube, and more particularly to a cathode structure of a magnetron for preventing damage and breakage of a thermal electron cathode of the magnetron.

Since the magnetron generates a high frequency power at a high efficiency it has been widely used in microwave oven and defreezers to heat or defreeze foods or the like. The magnetron basically comprises a ring anode and a thermal electron emitting cathode disposed at the center of the anode. The thermal electron emitting cathode comprises a helical filament which is arranged coaxially with a cylinder axis of the magnetron and fixed by and electrically connected to an upper end shield and a lower end shield which prevent the axial escape of the thermal electrons. The upper end shield is fixed to an upper end of a center lead on the cylinder axis while the lower end shield is fixed to an upper end of a side lead such that the center lead extends through the center of a circular hole in the lower end shield. Terminals are brazed together with stem ceramics to the lower ends of the center lead and the side leads. The filament is fed with electric power through those terminals. Brazed to the stem ceramics are shielding members which constitute portions of a vaccum envelope of the magnetron.

The filament may be made of a thorium tungsten wire which is carbonized to enhance thermal electron emission efficiency. As a result, a carbonized layer is formed on the surface of the wire resulting in the brittleness of the filament. When various external parts are to be mounted on the magnetron having such a filament, the mechanical vibration propagates to the filament through the center lead and the side lead so that the filament may be damaged or broken. When the magnetron is dropped during the handling thereof, the mechanical vibration also propagates to the filament. In order to prevent such vibration, a spacer is placed at a predetermined distance from the lower end shield so that the center lead and the side lead extend therethrough. Since the center lead and the side lead have different lengths, they have different resonance points or resonance frequencies for an external vibration. Accordingly, coupling of the leads by the single spacer serves to prevent the vibration and enhances the resistance to the vibration of the overall cathode. This effect is materially influenced by the position at which the spacer is mounted, and it is desirable from a viewpoint of antivibration to mount the spacer as close to the filament as possible. When the filament is brazed (usually with a high melting point metal such as ruthenium-molybdenum alloy or platinum) to the upper end shield and the lower end shield, a heating filament is arranged around those members. If the spacer is too close to the lower end shield, the spacer may be melted by the high temperature radiation heat. While the spacer is made of ceramic which is known as a relatively high heat resistive material, it must be positioned about 10 mm or more, for example, from the lower end shield to prevent fushion damage. Thus, since the spacer supports the center lead and the side lead at a point distant from the filament, that is, at a point at which the center lead and the side lead vibrate less, the antivibration effect is small. In addition, it has a directivity such that the antivibration effect to the vibration transverse to the direction of the alignment of the center lead and the side lead is small.

On the other hand, the diameters of the center lead and the side lead may be increased to enhance the ridigity thereof in order to enhance the resistance to the vibration of the cathode. However, since those leads are made of expensive molybdenum or tunsten material, it necessarily leads to an increase in the cost and hence it is not desirable.

SUMMARY OF THE INVENTION

It is an object of the present invention to provide a cathode structure for an electon tube of the type described which can enhance the antivibration effect on a center lead and a side lead thereof.

It is another object of the present invention to provide a low cost cathode structure for an electron tube which provides an enhanced antivibration effect on the center lead.

To attain the above objects, in accordance with the present invention, a spacer made of a heat resistive and insulating material such as ceramic is interposed in a space between a lower end shield and the center lead to prevent the vibration of the leads, particularly of the center lead. The spacer is held in place by a support member attached to the center lead.

According to another aspect of the present invention, an outer surface of the spacer makes contact with an inner wall of a shielding member which constitutes a portion of a vacuum envelope of the magnetron and the spacer has an aperture through which the center lead and the side lead extend. This construction prevents the vibration of the leads.

BRIEF DESCRIPTON OF THE DRAWINGS

DESCRIPTION OF THE PREFERRED EMBODIMENTS

For better understanding of the present invention, an overall structure and a cathode structure of a prior art magnetron are first explained with reference to the drawings.

Figure 1:
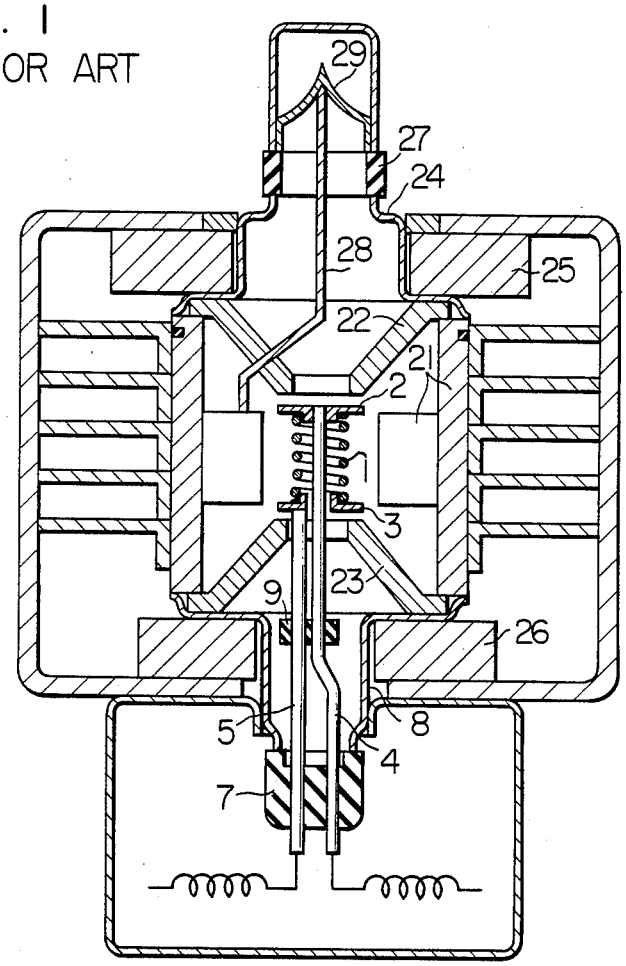
FIG. 1 PRIOR ART
FIG. 1 is a sectional view showing an overall structure of a prior art magnetron.

In FIG. 1, numeral 1 denotes a thermionic emission cathode consisting of a filament, 2 an upper end shield, 3 a lower end shield, 4 a center lead, 5 a side lead, 7 a stem ceramic, 8 a shielding member, 9 a spacer, 21 a ring anode, 22 and 23 magnetic poles, 24 an upper vacuum shielding member, 25 and 26 permanent magnets, 27 an insulator at an output terminal, 28 an antenna for radiating high frequency power, and 29 an evacuation tube which is sealed after an anode-cathode active space has been evacuated. In the structure shown, the anode-cathode active space is kept in vacuum by an envelope formed by the components 7, 8, 21, 24, 27 and 29, and the high frequency power is radiated from the evacuation tube 29 and a cap mounted thereon through the antenna 28.

Figure 2:
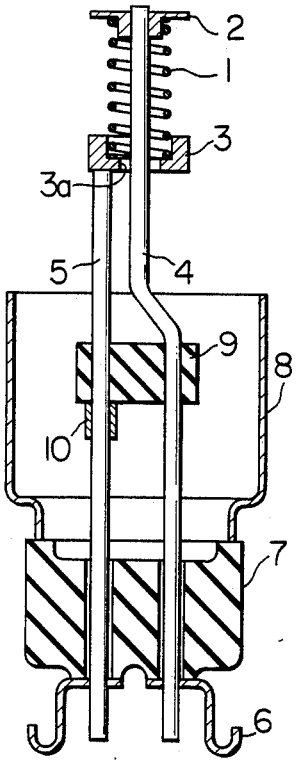
FIG. 2 PRIOR ART
FIG. 2 is a sectional view showing an example of a cathode structure of a prior art magnetron.

FIG. 2 shows the cathode structure of the magnetron in detail. In FIG. 2, numeral 6 denotes a terminal which is brazed together with the stem ceramic 7 at lower ends of the center lead 4 and the side lead 5, and numeral 10 denotes a support member for supporting the spacer 9 made of a heat resistive and insulating material such as ceramic in place.

As described above, the spacer 9 cannot give a significant antivibration effect to the center lead and the side lead.

Figure 3:
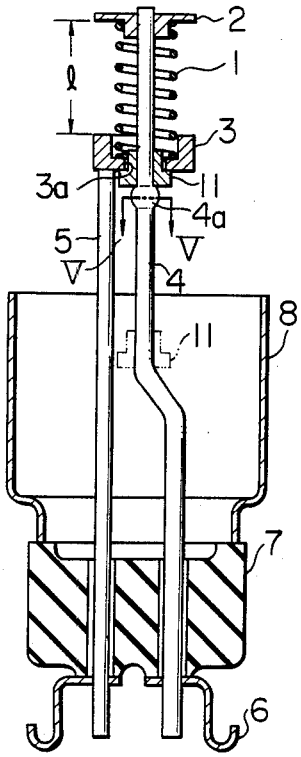
FIG. 3 is a sectional view showing a cathode structure of a magnetron in accordance with one embodiment of the present invention.
Figure 4:
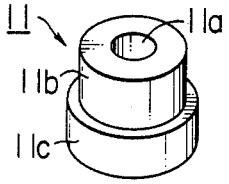
FIG. 4 is a perspective view of one embodiment of a spacer.

The present invention will now be explained with reference to the illustrated embodiments. FIG. 3 is a sectional view of one embodiment of an electron tube cathode structure in accordance with the present invention. In accordance with the present invention, the vibration of the center lead is prevented based on the fact that the breakage or damage of the filament is mainly due to the vibration of the center lead. The like elements to those shown in FIG. 2 are designated with the same numerals and they are not explained here. As shown in FIG. 3, a spacer 11 made of heat resistive and insulating material such as ceramic is inserted between an aperture, e.g. a circular aperture 3*a* of the lower end shield 3 and an outer surface of the center lead 4. The spacer 11 is held by a projection 4*a* formed on the center lead 4. As shown in FIG. 4, the spacer 11 has a through hole 11*a* through which the center lead 4 extends, a smaller diameter cylindrical outer wall 11*b* which loosely fits the circular aperture 3*a* of the lower end shield 3 and a larger diameter cylindrical outer wall or flange 11*c* which abuts against the lower surface of the lower end shield 3.

Figure 5:
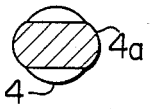
FIG. 5 is a sectional view showing a support member in the embodiment shown in FIG. 3.

In constructing the electron tube cathode structure shown, the spacer 11 is previously mounted on the center lead 4 at a position shown by a double chain line and the filament 1 is brazed to the upper end shield 2 and the lower end shield 3. Since brazing is carried out with the spacer 11 disposed away from the lower end shield 3, the spacer 11 is prevented from being melted. Thereafter, the spacer 11 is fitted to the circular aperture 3*a* of the lower end shield 3 and the center lead 4 is pressed to form its cross-sectional shape as shown in FIG. 5 to form the projection 4*a* so that the spacer 11 is held by the projection 4*a*.

Since the spacer 11 is held by the lower end shield 3 and the center lead 4 at a position very close to the filament 1, the resonance of the center lead 4 in any direction can be prevented by the side lead 5 through the spacer 11 and the lower end shield 3.

In a magnetron having an outer diameter of the filament 1 of 5 mm and a space l between the upper and lower end shields 2 and 3 of 8–12 mm, a practically sufficient antivibration effect was attained when a space between the smaller diameter cylindrical wall 11*b* of the spacer 11 and the circular aperture 3*a* of the lower end shield 3 is not larger than approximately 0.3 mm (or a difference between the diameters of those elements is 0.6 mm). This value depends on the size of the magnetron. It will be readily understood that the narrower the space is the greater is the antivibration effect. However, the narrower space leads to an increase in cost due to the accuracy requirement. In this aspect, a necessary space for the construction is chosen.

Since the antivibration effect is attained within a limited range of the space, the spacer can be readily mounted by the presence of the space even when the spacer 11 is eccentric to the center lead 4 when the former is fitted to the lower end shield 3.

As described above, a sufficient antivibration effect is attained when the spacer between the circular aperture 3*a* of the lower end shield 3 and the spacer 11 is approximately 0.3 mm. Accordingly, a similar effect would be attained without using the spacer 11 but instead by making the circular aperture 3*a* of the lower end shield 3 smaller so that the space between it and the center lead 4 is no larger than 0.3 mm. However, this construction would be inappropriate for mass production at a high reliability because the brazing material will scatter when the filament 1 is brazed and it will shorten the space since the space between the lower end shield 3 and the center lead 4 is small, in the order of 0.3 mm, as described above.

Figure 6:
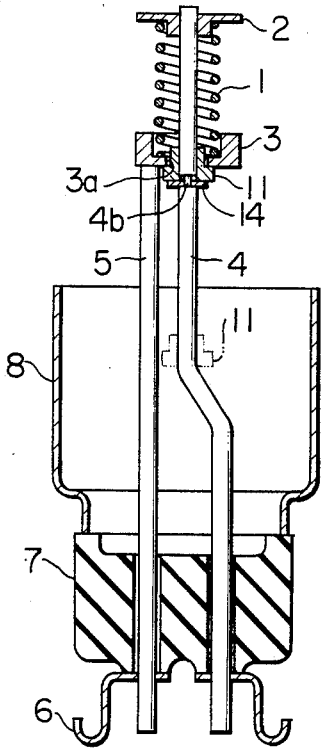
FIG. 6 is a sectional view of a cathode structure in accordance with another embodiment of the present invention.
Figure 8:
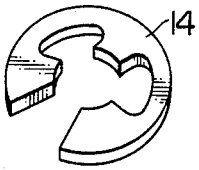
FIG. 8 is a perspective view of one embodiment of the support member used in the embodiment shown in FIG. 6.

FIG. 6 shows another embodiment of the present invention. In the previous embodiment, the spacer 11 is held by the projection 4*a* formed on the center lead 4. In the present embodiment, a ring groove 4*b* is formed in the center lead 4 and a so-called E-ring 14 as shown in FIG. 8, which is a commercially available E-shaped flexure member (JIS standard), is fitted to the groove 4*b* as a support member. In the present embodiment, like in the previous embodiment, the spacer 11 is previously fitted to the center lead 4 at a position shown by a double chain line and the filament 1 is brazed to the upper end shield 2 and the lower end shield 3. Thereafter, the spacer 11 is fitted to the circular aperture 3*a* of the lower end shield 3 and then the E-ring 14 is fitted to the groove 4*b*. This construction attains the same effect as that attained in the previous embodiment.

Figure 7:
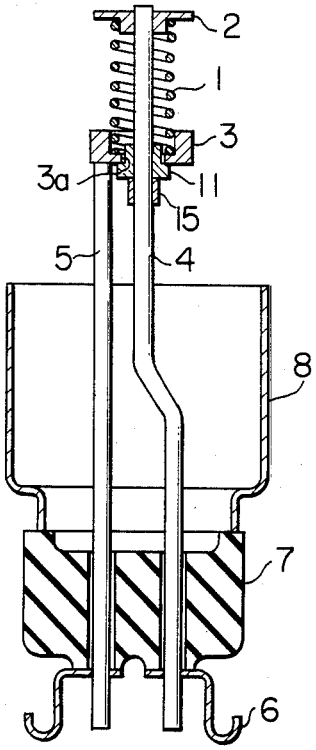
FIG. 7 is a sectional view showing a cathode structure in another embodiment of the present invention.
Figure 9:
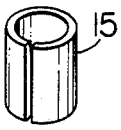
FIGS. 9 and 10 are perspective views of other embodiments of the support member.
Figure 10:
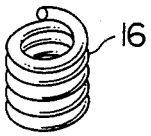

FIG. 7 shows a further embodiment of the present invention. In the present embodiment, a metal sleeve 15 shown in FIG. 9 or a coil 16 shown in FIG. 10 is used as a support member to hold the spacer 11. Like in the previous embodiments, the sleeve 15 or the coil 16 is fitted to the center lead 4 and the spacer 11 is fitted to the circular aperture 3*a* of the lower end shield 3. Thereafter, the sleeve 15 or the coil 16 is fixed to the center lead 4 by spot welding. This construction also attains the same effect as attained in the previous embodiments.

The temperature of the area at which the support member such as the E-ring 14, the sleeve 15 or the coil 16 in FIGS. 6–10 is mounted reaches a high temperature such as 1000° C. during the operation of the magnetron. Accordingly, when the support member 14, 15 or 16 is made of a material having a getter action, such as titanium, niobium, tantalum or zirconium is used, a vigorous gettering action is attained. This is useful to provide a magnetron of high vacuum, highly stable in operation and highly reliable.

As is apparent from the explanation set forth above, according to the electron tube cathode structures of the illustrated embodiments, the antivibration effect of the center lead and the side lead is significantly enhanced and hence the diameters of the leads which are made of expensive material such as molybdenum or tungsten can be reduced and the cost can be reduced accordingly. When the gettering material is used as the support member to hold the spacer, a highly reliable magnetron can be obtained.

Figure 11:
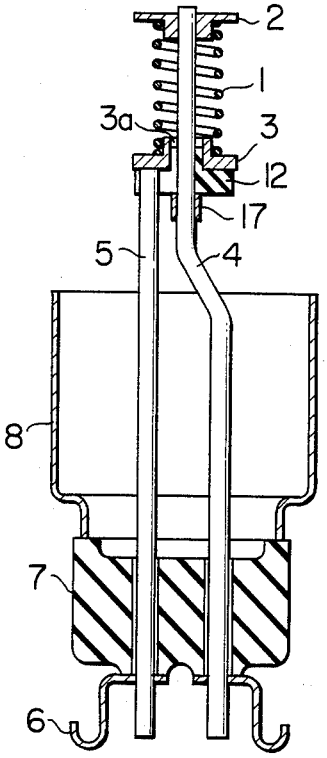
FIG. 11 is a sectional view showing a cathode structure in a further embodiment of the present invention.
Figure 12:
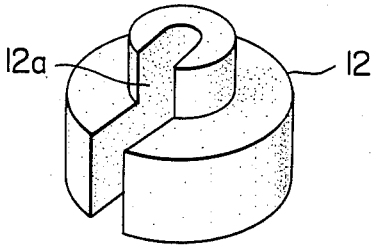
FIG. 12 is a perspective view of a spacer used in the embodiment shown in FIG. 11.

FIG. 11 shows another embodiment of the present invention, in which numeral 12 denotes a spacer in accordance with the present embodiment and numeral 17 denotes a metal ribbon for preventing the movement of the spacer. FIG. 12 is a perspective view of the spacer 12 used in the present embodiment in which numeral 12*a* denotes a cut-out. As seen from FIGS. 11 and 12, the spacer 12 in the present embodiment can be mounted after the cathode elements such as the filament 1, the upper end shield 2, the lower end shield 3, the center lead 4 and the side lead 5 have been assembled and brazed. The cylindrical wall of the spacer 12 is fitted to the circular aperture 3*a* of the lower end shield 3 and the cut-out 12*a* grasps the side lead 5 near the periphery thereof. Therefore, relative displacement of the lower end shield 3, the side lead 5 and the spacer 12 is prevented. While the center lead 4 is shaped such that it can move in the cut-out 12*a* circumferentially of the spacer 12, it does not move at the crosspoint of the center lead 4 and the spacer 12 because of the friction with the cut-out surface and because it can move only in one direction (cannot move reversely). By coupling the leads by means of the spacer 12 in this manner, a sufficient antivibration effect was attained. The metal ribbon 17 for preventing the displacement may be wrapped around the lead and welded to it.

Figure 13:
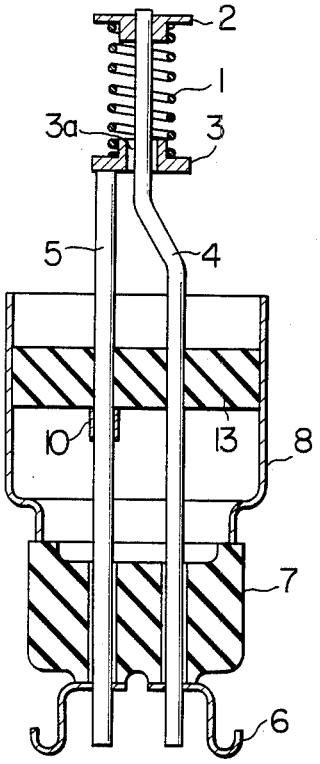
FIG. 13 is a sectional view showing a cathode structure in a still further embodiment of the present invention.

FIG. 13 shows a still further embodiment of the electron tube cathode structure in accordance with the present invention. As shown in FIG. 13, the spacer 13 is supported by the shielding member 8. Since the spacer 13 has its outer circumference in contact with the inner circumferential surface of the shielding member 8, the spacer is substantially fixed to the shielding member 8. As a result, it can absorb energy when a large vibration is applied and can attain a higher antivibration effect. Numeral 10 denotes a support member for supporting the spacer 13 and it can be selected from the members shown in FIGS. 7, 9 and 10.

Figure 14A:
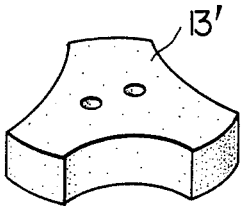
FIGS. 14*a* and 14*b* are perspective views of different embodiments of a spacer used in the embodiment shown in FIG. 13.
Figure 14B:
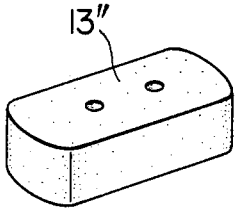

Since the spacer 13 itself affects the operation of the magnetron as a part of the cathode structure of the magnetron, the spacer 13 may be shaped as shown in FIG. 14*a* in which three cut-outs are formed at the periphery or in FIG. 14*b* in which both sides are cut out so that the amount of reheating of the cathode due to the collison of the thermal electrons to the filament 1 of the cathode can be controlled.

It has been proven that an effective antivibration effect is attained when the space between the spacer 13 and the shielding member 8 is not larger than 0.2 mm. This avoids the accuracy requirement which would otherwise lead to an increase of cost in the assembly process.

As is apparent from the explanation set forth above, according to the electron tube cathode structures of the present invention, the resonance of the center lead and the side lead by the externally applied vibration is prevented and hence the diameters of the leads can be reduced and the cost can be reduced.

Furthermore, since the spacers of the present invention have wider flat areas than that of the prior art spacer, various forms of metallized film which have been widely used can be formed. This makes it easy to control the reheating of the cathode which affects the operation of the magnetron.

What is claimed is:

1. A cathode structure for an electron tube comprising a center lead;

a side lead extending substantially parallel with said center lead;

an upper end shield fixed at an end of said center lead;

a lower end shield having a first aperture and fixed to an end of said side lead, said center lead extending through said first aperture;

a filament fixed to and electrically connected to said upper end shield and said lower end shield;

a spacer made of heat resistive and insulating material disposed in said first aperture between said center lead and said lower end shield; and a support member for supporting said spacer;

wherein said spacer has an aperture through which said center lead extends, a projection adapted to be fitted to said first aperture and a flange adapted to be abutted against one surface of said lower end shield.

2. A cathode structure for an electron tube according to claim 1 wherein said support member is a projection formed on said center lead.

3. A cathode structure for an electron tube comprising a center lead;

a side lead extending substantially parallel with said center lead;

an upper end shield fixed at an end of said center lead;

a lower end shield having a first aperture and fixed to an end of said side lead, said center lead extending through said first aperture;

a filament fixed to and electrically connected to said upper end shield and said lower end shield;

a spacer made of heat resistive and insulating material disposed in said first aperture between said center lead and said lower end shield; and a support member for supporting said spacer;

wherein said center lead has a ring groove and said support member is an E-type flexure member adapted to be fitted to said groove.

4. A cathode structure for an electron tube comprising a center lead;

a side lead extending substantially parallel with said center lead;

an upper end shield fixed at an end of said center lead;

a lower end shield having a first aperture and fixed to an end of said side lead, said center lead extending through said first aperture;

a filament fixed to and electrically connected to said upper end shield and said lower end shield;

a spacer made of heat resistive and insulating material disposed in said first aperture between said center lead and said lower end shield; and a support member for supporting said spacer;

wherein said support member is either one of a sleeve and a coil.

5. A cathode structure for an electron tube according to claim 4 wherein said support member is made of a material selected from a group consisting of titanium, niobium, tantalum and zirconium.

6. A cathode structure for an electron tube comprising a center lead;

a side lead extending substantially parallel with said center lead;

an upper end shield fixed at an end of said center lead;

a lower end shield having a first aperture and fixed to an end of said side lead, said center lead extending through said first aperture;

a filament fixed to and electrically connected to said upper end shield and said lower end shield;

a spacer made of head resistive and insulating material disposed in said first aperture between said center lead and said lower end shield; and a support member for supporting said spacer;

wherein said spacer has a groove through which said center lead and said side lead extend, a projection adapted to be fitted to said first aperture and a flange adapted to be abutted against one surface of said lower end shield.

7. A cathode structure for an electron tube comprising;

a center lead, a side lead extending substantially parallel with said center lead, an upper end shield fixed to an end of said center lead, a lower end shield having a circular aperture and fixed to an end of said side lead, said center lead extending through said circular aperture, a filament disposed between said upper end shield and said lower end shield, a cylindrical shielding member forming a portion of a vacuum envelope of said electron tube, and a spacer made of a heat resistive and insulating material through which said center lead and said side lead extend, said spacer being arranged within said shielding member so as to be supported by the inner circumferential surface thereof.

8. A cathode structure for an electron tube according to claim 7 wherein said spacer is in contact with said shielding member at least at two inner circumferential surface areas thereof to prevent the vibration of said center lead and said side lead.

* * * * *